US009352904B1

(12) United States Patent
Wall

(10) Patent No.: US 9,352,904 B1
(45) Date of Patent: May 31, 2016

(54) TRASHCAN HAVING A DETACHABLE LINER ENGAGEMENT MEMBER

(71) Applicant: Test Rite Products Corp, Ontario, CA (US)

(72) Inventor: Joseph Wall, Thatcher, AZ (US)

(73) Assignee: TEST RITE PRODUCT CORP., Ontario, CA (US)

( * ) Notice: Subject to any disclaimer, the term of this patent is extended or adjusted under 35 U.S.C. 154(b) by 0 days.

(21) Appl. No.: 14/595,365

(22) Filed: Jan. 13, 2015

(51) Int. Cl.
*B65D 25/14* (2006.01)
*B65F 1/06* (2006.01)
*B65F 1/14* (2006.01)

(52) U.S. Cl.
CPC .... *B65F 1/06* (2013.01); *B65F 1/14* (2013.01)

(58) Field of Classification Search
CPC ..... B65F 1/06; B65F 1/14; B65F 1/1415; Y10T 16/44; B65D 25/28
USPC ..... 220/908, 908.1, 908.2, 908.3, 909, 910, 220/911, 495.11, 495.01, 495.03, 495.06, 220/756, 759, 770, 769, 772; 16/425, 422
See application file for complete search history.

(56) References Cited

U.S. PATENT DOCUMENTS 4,923,087 A * 5/1990 Burrows ..... B65F 1/06 220/495.1
2009/0261106 A1* 10/2009 Stelmach ..... B65F 1/06 220/495.11
2011/0272409 A1* 11/2011 Kasbohm ..... B65F 1/06 220/495.11

* cited by examiner

*Primary Examiner* — Robert J Hicks
*Assistant Examiner* — Kareen Thomas
(74) *Attorney, Agent, or Firm* — Treasure IP Group, LLC

(57) ABSTRACT

A trashcan assembly has a trashcan container, a removable trashcan liner engagement member and a holder for the trashcan linear engagement member. The removable trashcan liner engagement member can be placed to loop around the holder and to be aligned with the exterior surface of the peripheral wall of the trashcan container.

12 Claims, 25 Drawing Sheets

Fig. 13 is a right side view of engagement element in figure 8

Fig. 22 is a left side view engagement element in figure 8

TRASHCAN HAVING A DETACHABLE LINER ENGAGEMENT MEMBER

FIELD OF THE INVENTION

The present invention relates to a receptacle having a liner engagement member, specifically it is related to a receptacle having a removable liner engagement member.

DESCRIPTION OF THE RELATED ART

Receptacles, in general, or trashcans mostly are used with disposable flexible liners such as a paper, cloth, or plastic bag, for easy and sanitary disposal of trash, which is thrown therein. Often times, the liner used for a trashcan interior is provided with extra length to enable an upper portion of the liner to be draped over the top rim of the trash can and to extend downwardly along a portion of an exterior surface of the trash can. However, if such a liner is left loosely draped over the top rim of the trashcan, the liner can easily slip into the interior of the trashcan when trash is placed in the trashcan.

One way to solve this problem is to have a tightening mechanism attached to the trashcan liner, but it is no practical to design said liner for every size and type of trashcan. Therefore a securing mechanism is needed so as to have the flexible trash can liner remain conformed to the side and top rim of the trash can so that the trashcan liner will not slip into the bottom of the trashcan when trash is placed in it.

SUMMARY OF THE INVENTION

The present invention discloses a receptacle having a detachable liner engagement member, which allows the liner to releasably conform to the top rim and sides of the receptacle. The receptacle as a trashcan in the present invention can be fitted with a variety of trashcan liners.

It is one object of the present invention to provide a trashcan which permits the liner be folded over the top rim of the trashcan but not drape a substantial length over the side of the trashcan. Therefore in the present invention, the liner engagement member is positioned near the top of the trashcan.

It is another object of the present invention, to provide a trashcan liner engagement member is easy to use and provide aesthetic value to the trashcan.

In another objet of the present invention, the trash can liner engagement member can secure the trashcan liner to the interior and rim of the trashcan body and prevent it from withdrawing into the base of the trashcan when a trash is received with great force.

The present invention disclosed herein, is directed to a trashcan assembly comprising a trashcan body, a removable trashcan liner engagement member, and a holder for the trashcan liner engagement member. The trashcan body comprises a base and a peripheral wall extending upwardly from said base, a top rim of said peripheral wall defining an opening of the trashcan body. The trashcan liner engagement member can be substantially aligned with the exterior surface of the peripheral wall when it is place onto the holder. The holder for the trashcan liner engagement member is positioned on the exterior of the peripheral wall of the trashcan body, configured to receive the trashcan liner engagement member. When the trashcan liner engagement member is received by the holder, a trashcan liner can be folded over the top rim of the peripheral wall and gathered to pass underneath the trashcan liner engagement member.

In one aspect of the present invention, the holder is a pair of clips, wherein the clips are substantially C-shaped, disposed in an opposite facing relationship with each other on the peripheral wall.

In another aspect of the present invention, wherein the removable trashcan liner engagement member is flexible, wherein the removable trashcan liner engagement member comprises a looping element, capable of being placed around the holder, and a stopping element, connected to the looping element, and being adapted to prevent the trashcan liner slip. The stopping element holds the trashcan liner by friction.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
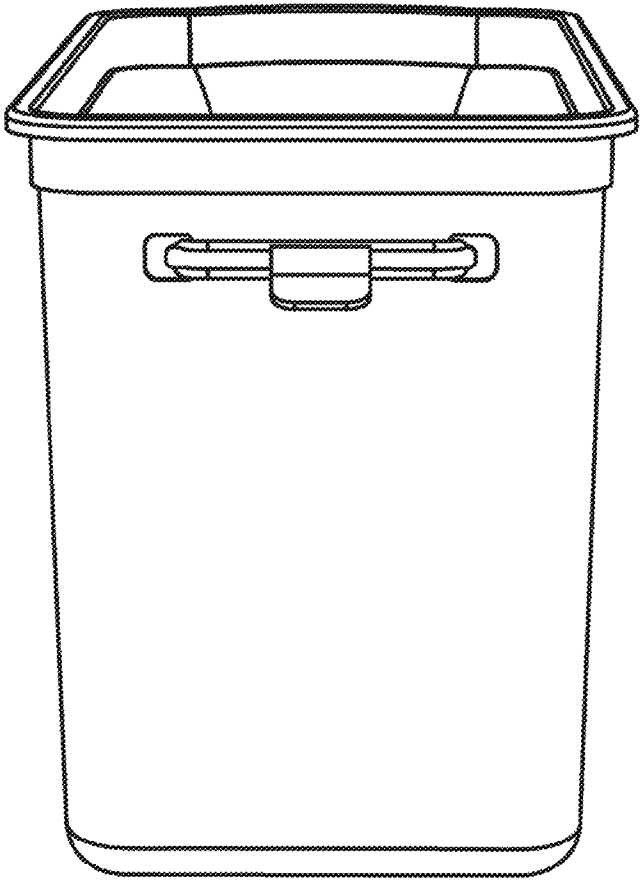
FIG. 1 is a drawing of a front perspective view of a trashcan having a liner engagement member when the liner engagement member is attached.
Figure 2:
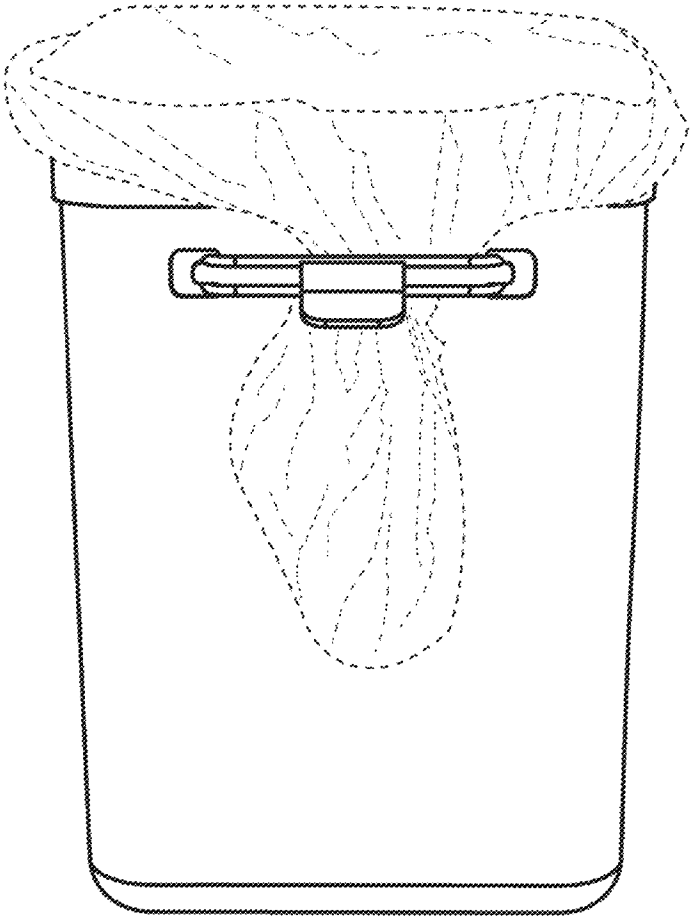
FIG. 2 is a drawing of the trashcan of FIG. 1, when a trash bag is placed in it as a use environment for the trashcan.
Figure 3:
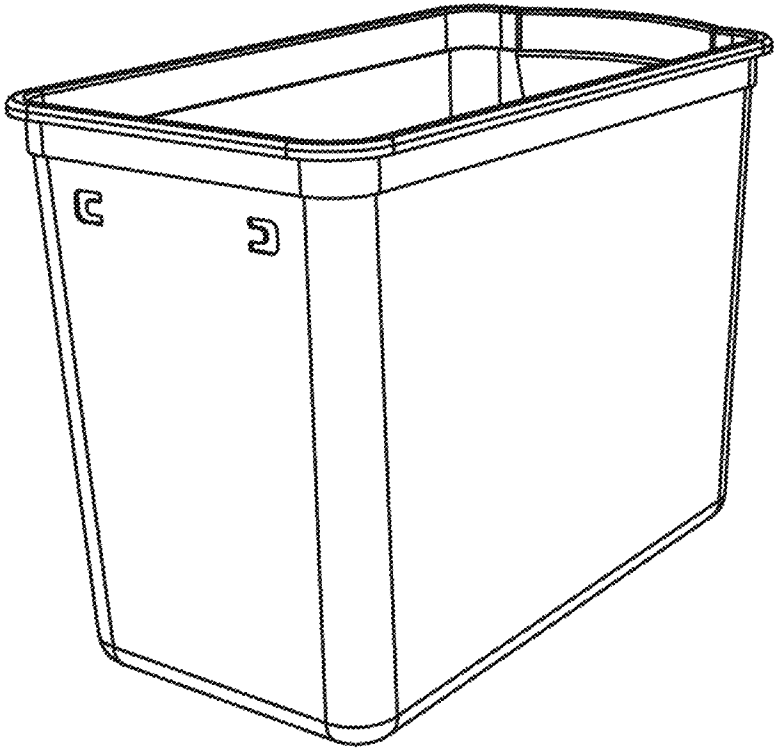
FIG. 3 is a drawing of a perspective view of the trashcan of FIG. 1, when the liner engagement member is detached from the trash can.
Figure 4:
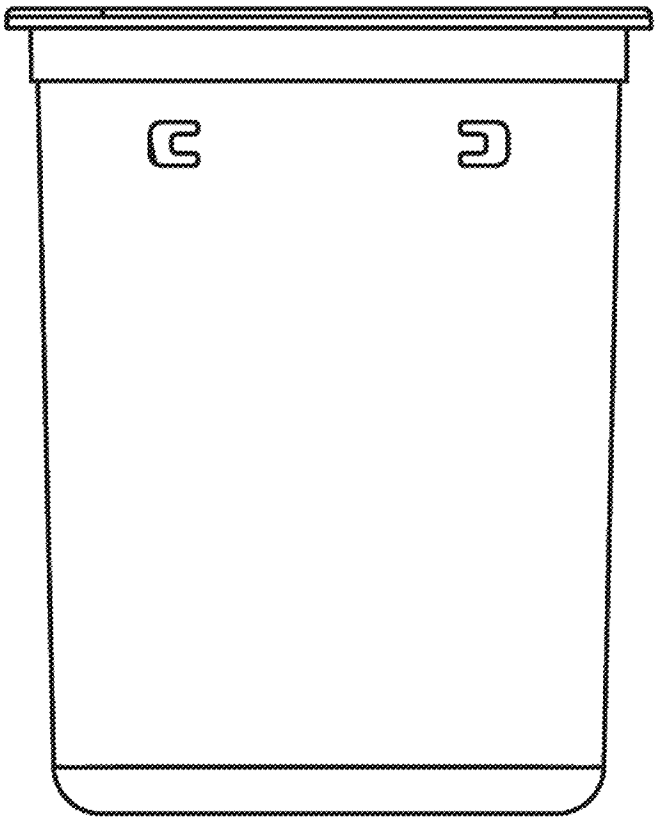
FIG. 4 is a drawing of a front view of the trashcan of FIG. 3, when the liner engagement member is detached from the trash can.
Figure 5:
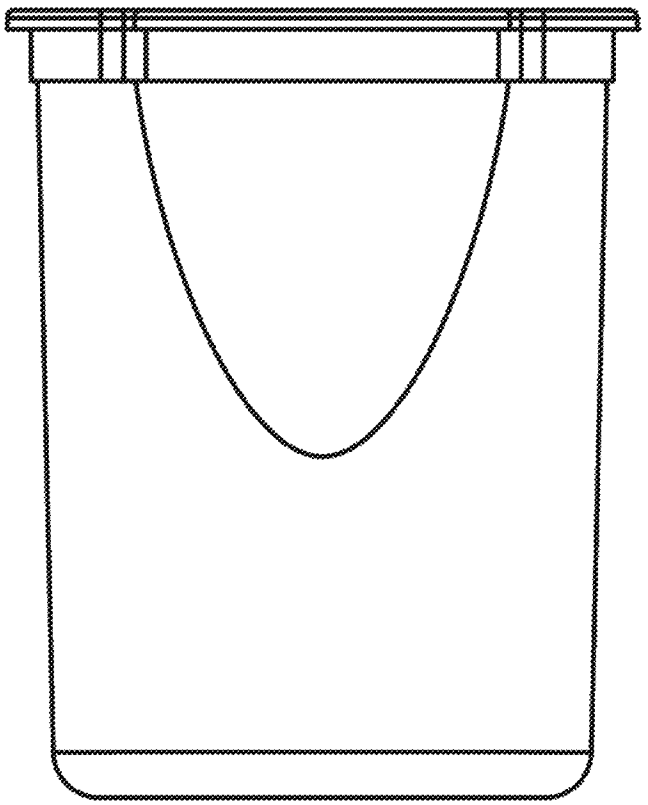
FIG. 5 is a drawing of a back view of the trashcan of FIG. 3.
Figure 6:
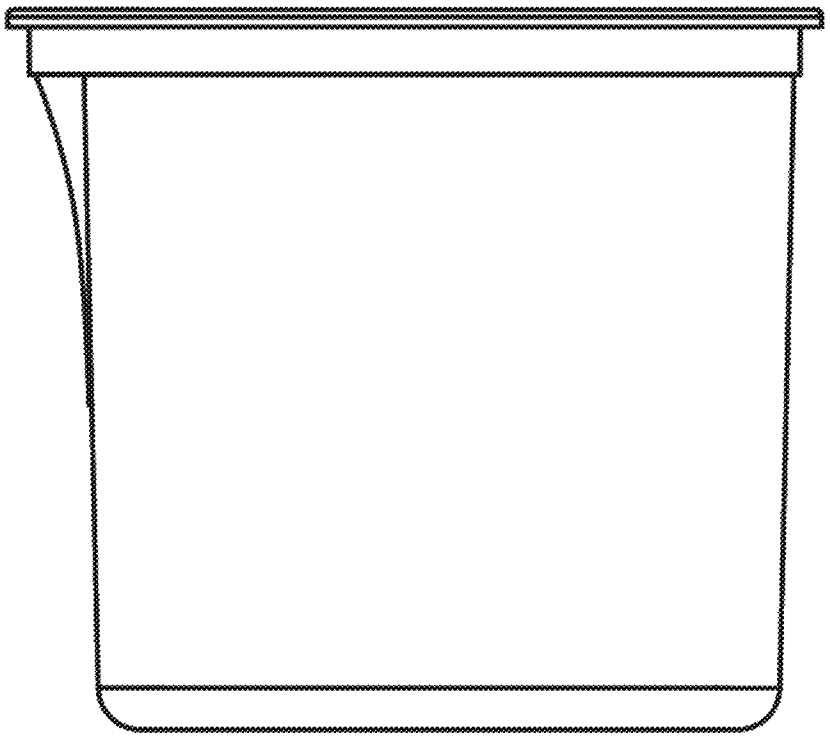
FIG. 6 is a left side view of FIG. 3.
Figure 7:
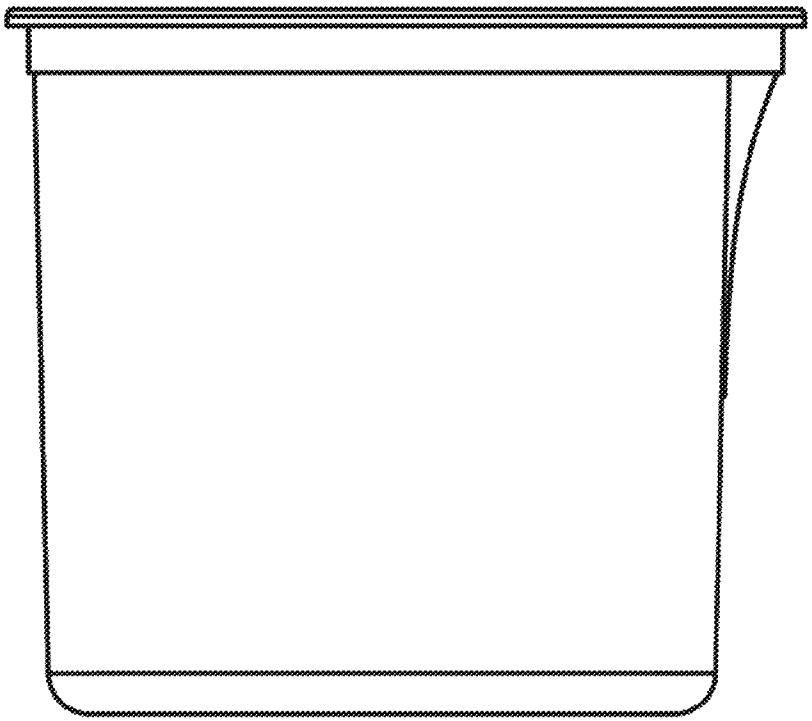
FIG. 7 is a right side view of FIG. 3.
Figure 8:
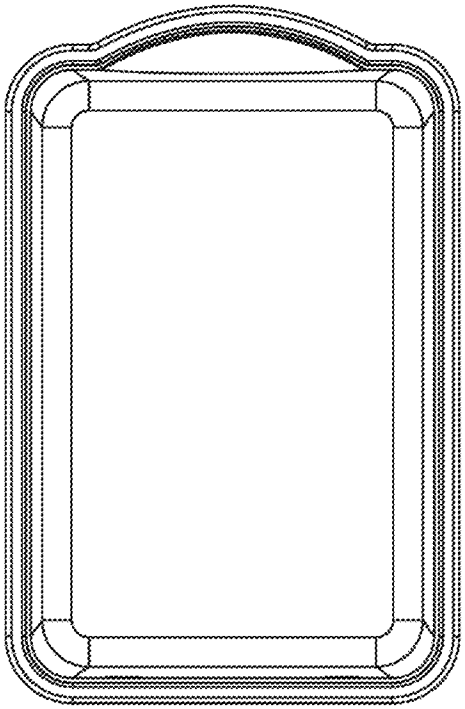
FIG. 8 is a top side view of FIG. 3.
Figure 9:
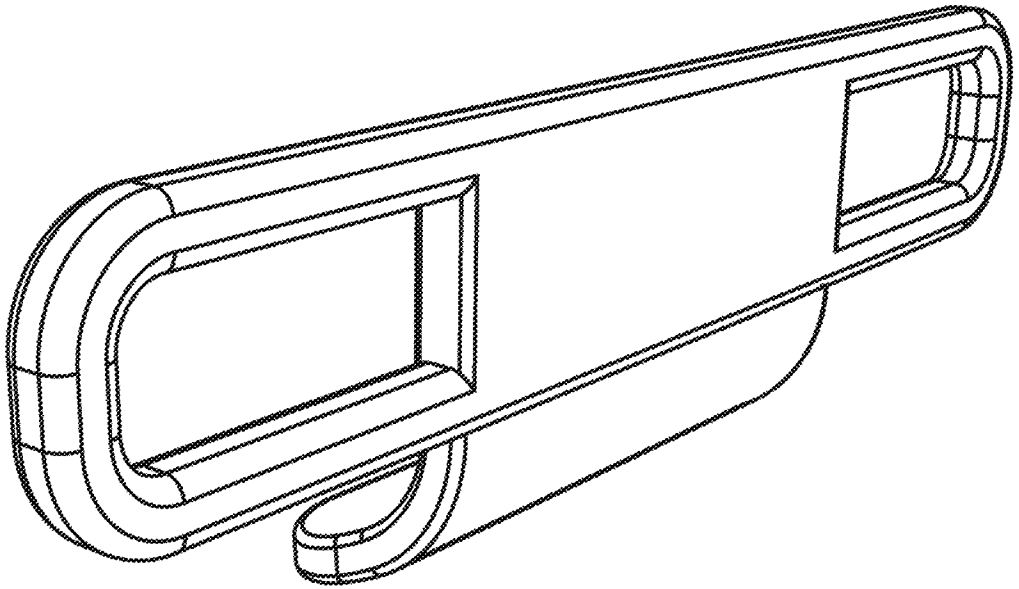
FIG. 9 is a perspective view of the liner engagement member in FIG. 1, when it is detached from the trashcan.

For purposes of summarizing the invention and the advantages achieved over the prior art, certain advantages of the invention have been described herein. It is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

In the scope of the present invention, the trash can assembly disclosed herein includes a trashcan body, which comprises a base and a peripheral wall extending upwardly from said base, a top rim of said peripheral wall defining an opening of the trashcan body, wherein the top rim of peripheral wall is opposite to the base of the trashcan body.

The trashcan body in accordance with the aspects of the present invention can be of any shape, including but not limited to cylinder and cubic shaped, or variations thereof. In one example, the trashcan is cylinder shaped having a base which is round or oval shaped. The peripheral wall is the one integral side. In another example the trashcan is rectangular or cubic shaped, and the peripheral walls consists of four sides, one connected to two neighboring sides. The trashcan body in accordance with the aspects of the present invention, can include additional surface features for both aesthetic and functional purposes. For example, the trashcan body can be tapered or having rings or grooves like surface features.

The trashcan body in accordance with the aspects of the present invention, the trashcan can be made of any type of material, including plastic, metal, wood, and bamboo or the like.

The trashcan can body disclosed in the present invention allows a flexible or pliable liner to be folded over the top rim of the trashcan, and drape over a top portion of the exterior wall of the trashcan body.

In accordance with the aspects of the present invention, the holder for trashcan liner engagement member and the trashcan liner engagement member work jointly to fasten and secure the hangover portion of the trashcan liner on the exterior surface of the peripheral wall. The holder can receive the liner engagement member using a secure means. The secure means includes any type of fasten or placement means that allows the liner engagement member to be releasably attached to the holder. The secure means includes but are not limited to female/male joint, an attachment like Velcro, a push in connector or magnetic attachment.

In accordance with one aspect of the present invention, in one embodiment, the holder is positioned on the exterior surface of the peripheral wall. The holder has a length, a longer side of the holder and a height, which is shorter then the length side of the holder. In one example, the holder is embedded on the exterior surface of the peripheral wall, wherein the height of the holder enters into a depth of the peripheral wall. In another example, the holder is formed above the exterior surface of the peripheral wall as a protrusion, wherein the height of the holder is emerged above the surface of the peripheral wall.

In accordance with another aspect of the present invention, the holder has a camouflage-like surface or geometry features in viewing the surrounding exterior of the peripheral wall of the trashcan body, so that the trashcan holder and/or the liner engagement member is integral to the trashcan.

In one embodiment, the holder has the same color as the exterior wall of the trashcan body.

In another example, the holder is made of the same material of the trashcan body or peripheral wall. In one instance, the holder is made of polypropylene.

In another embodiment, the holder has the same shape or geometry of the exterior wall. For example, the holder has a first surface and the first surface substantially resembles the exterior surface of the peripheral wall. In one example, the first surface is coplanar with the exterior surface of the peripheral wall. In another example, the trashcan body is cylinder shaped and the exterior surface of the peripheral wall has a curvature, and the first surface of the holder has the same curvature as the exterior surface of the peripheral wall.

In another embodiment the holder should be strong enough to provide support for the liner engagement member yet small enough to provide a continuous or smooth appearance of the exterior surface of the peripheral wall. In one example, the holder has a length, which is about 4-7% of the width of the trashcan. In another example, the holder has a width, which is about 4-7% of the height of the trashcan body.

In another aspect of the present invention, in one embodiment, the holder is incorporated onto the trashcan body at the time of manufacturing. In another embodiment, the holder is added to the trashcan body after the trashcan body has been formed.

Referring to FIGS. 3-8, in one embodiment of the present invention, the holder consists essentially of a pair of clips, positioned side by side. Optionally, the clips are placed on the same side of the peripheral wall. Preferably, the centers of clips are arranged at the same height away from the base of the trashcan.

In the example illustrated by FIGS. 3-8 and 25, the holder substantially resembles a pair of C-shaped clips or half circle shaped clips. The holder is arranged so that when the liner engagement member is placed onto the clips, a looping member of the liner engagement member is conformal to the exterior surface of the peripheral wall.

In accordance with the aspects with present invention, the trashcan assembly comprises a removable liner engagement member and said liner engagement member is flexible. In one example, the liner engagement member is made of silicone. In another example the liner engagement member is made of rubber.

In one embodiment of the present invention, as illustrated by FIGS. 9-14, the liner engagement member comprises a looping element and a stopping element. The looping element comprises a left arm and a right arm and two lateral connecting element arranged crosswise between the looping element and the stopping element. Further the stopping element is integrally connected with the bottom lateral connecting element and extended to the top connecting element. Additionally, a portion of the stopping element is curved and can bend pointing toward the exterior surface of the peripheral wall.

When the liner engagement member is placed onto the holder, the left arm and right arm of the looping element are set on the left and right clips and the two lateral connecting elements are slightly stretched between the two clips, and the surface of the stopping element is adhered to the liner or an exterior peripheral wall.

Figure 10:
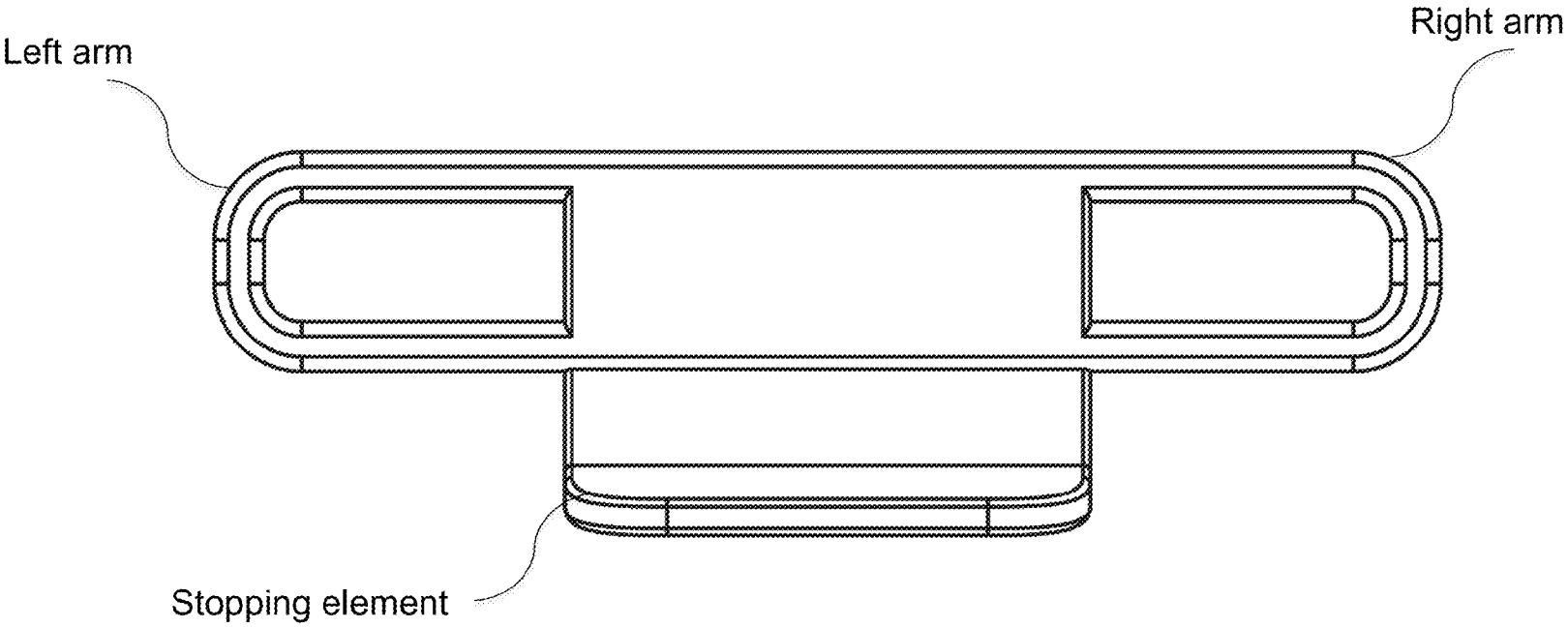
FIG. 10 is a front view of the liner engagement member in FIG. 9, when it is detached from the trashcan.
Figure 11:
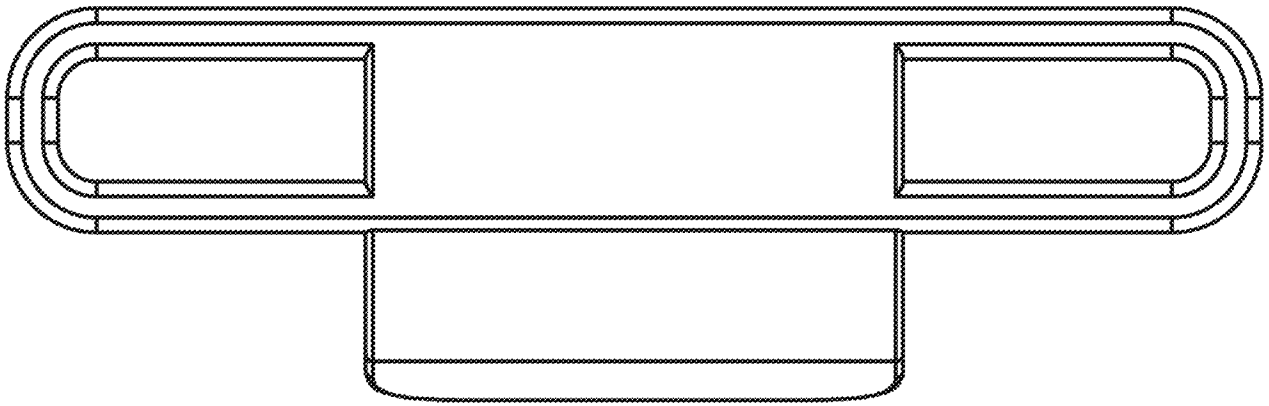
FIG. 11 is a back view of the liner engagement member in FIG. 9, when it is detached from the trashcan.
Figure 12:
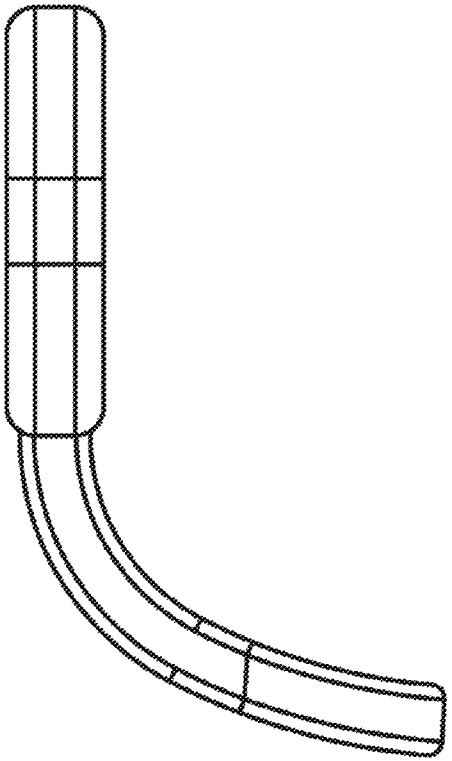
FIG. 12 is a left side view of the liner engagement member in FIG. 9.
Figure 13:
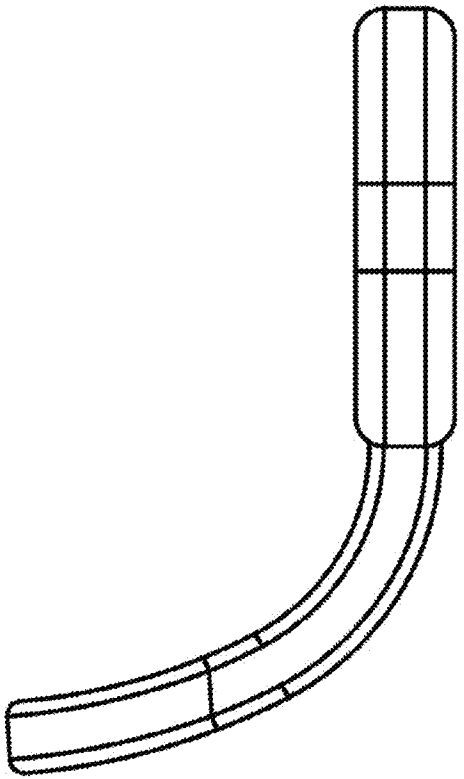
FIG. 13 is a right side view of the liner engagement member in FIG. 9.
Figure 14:
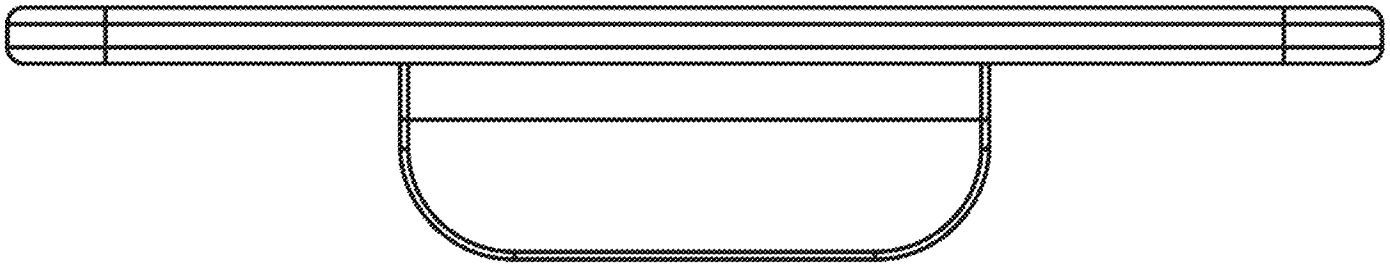
FIG. 14 is a top view of engagement of the liner member in FIG. 9.
Figure 15:
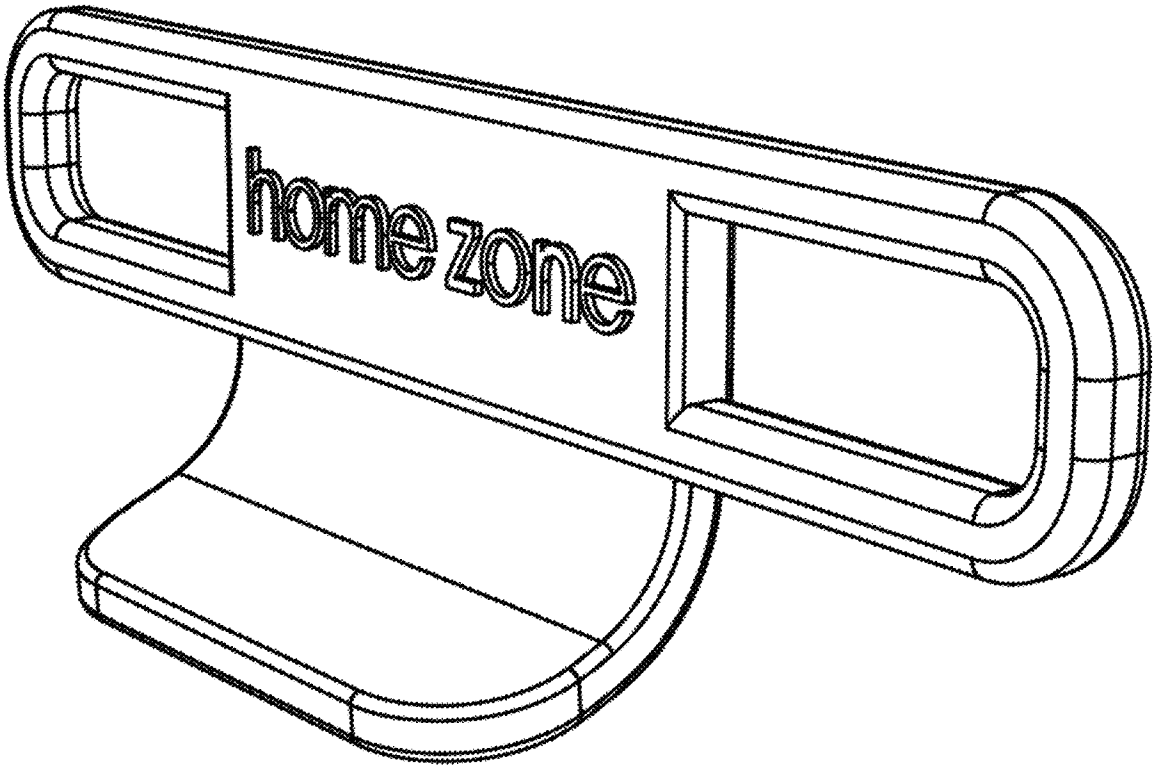
FIG. 15 is back perspective view of an alternative embodiment of the engagement member of FIG. 9.
Figure 16:
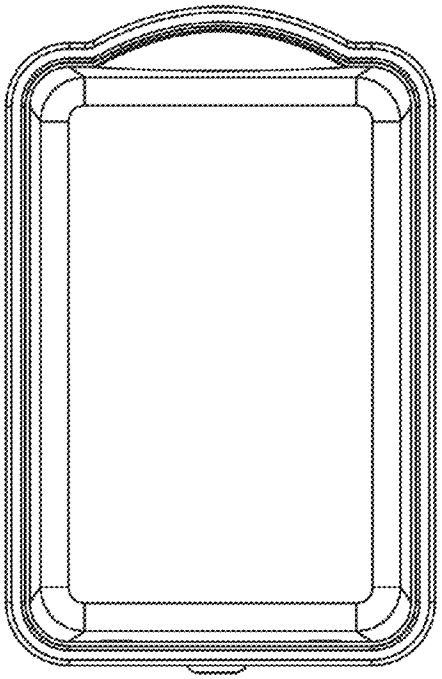
FIG. 16 is a top view of FIG. 1.
Figure 17:
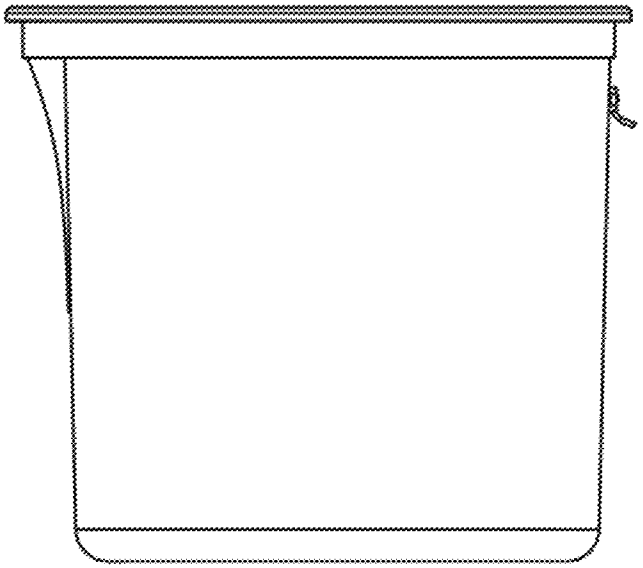
FIG. 17 is a left side view of FIG. 1.
Figure 18:
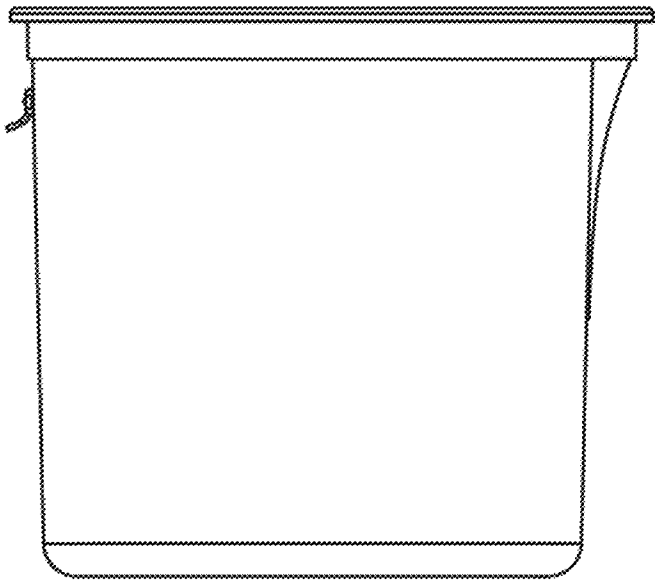
FIG. 18 is a right side view of FIG. 1.
Figure 19:
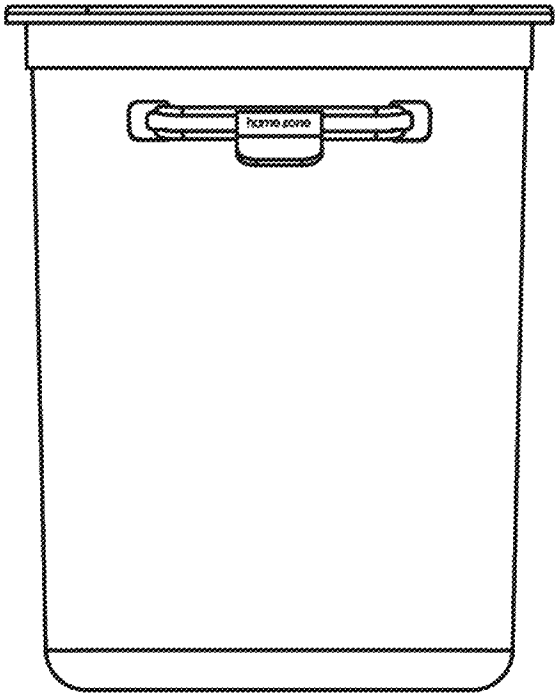
FIG. 19 is a right side view of FIG. 1.
Figure 20:
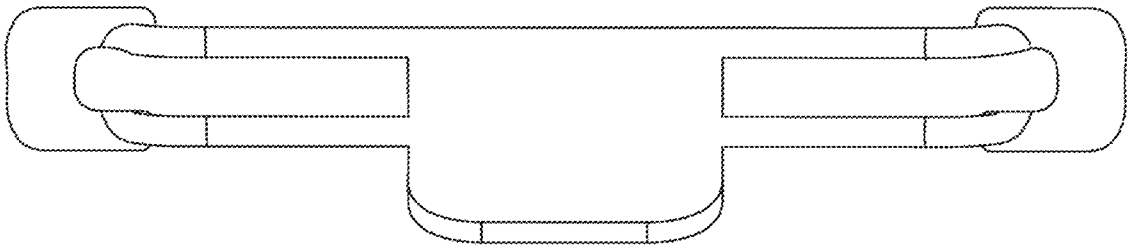
FIG. 20 is a detailed view of liner engagement member when it is attached to the trashcan as in FIG. 19.
Figure 21:
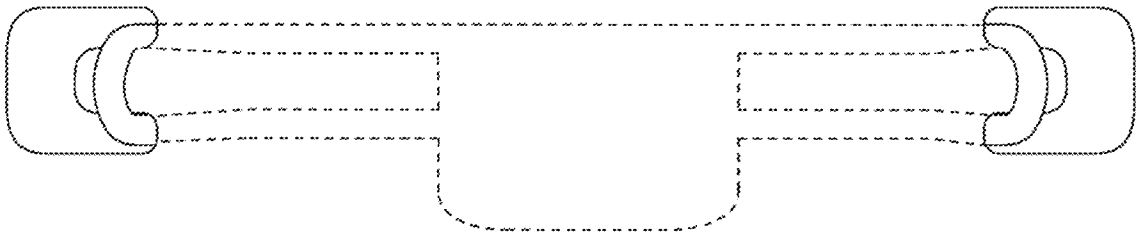
FIG. 21 is a back view of the liner engagement member when it is attached to the trashcan as in FIG. 19.
Figure 22:
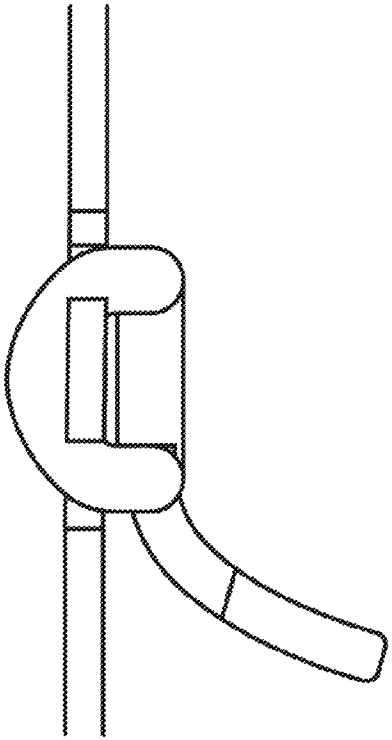
FIG. 22 is a detailed view of liner engagement member when it is attached to the trashcan as in FIG. 17.
Figure 23:
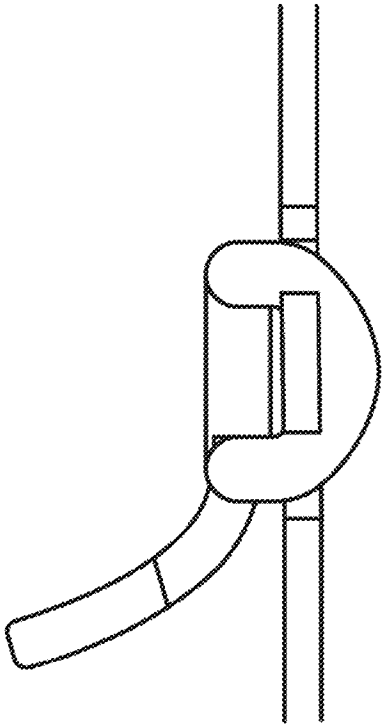
FIG. 23 is a detailed view of liner engagement member when it is attached to the trashcan as in FIG. 18.
Figure 24:
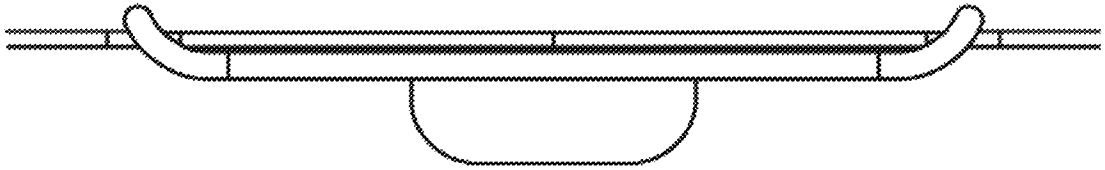
FIG. 24 is a detailed view of liner engagement member when it is attached to the trashcan as in FIG. 16.
Figure 25:
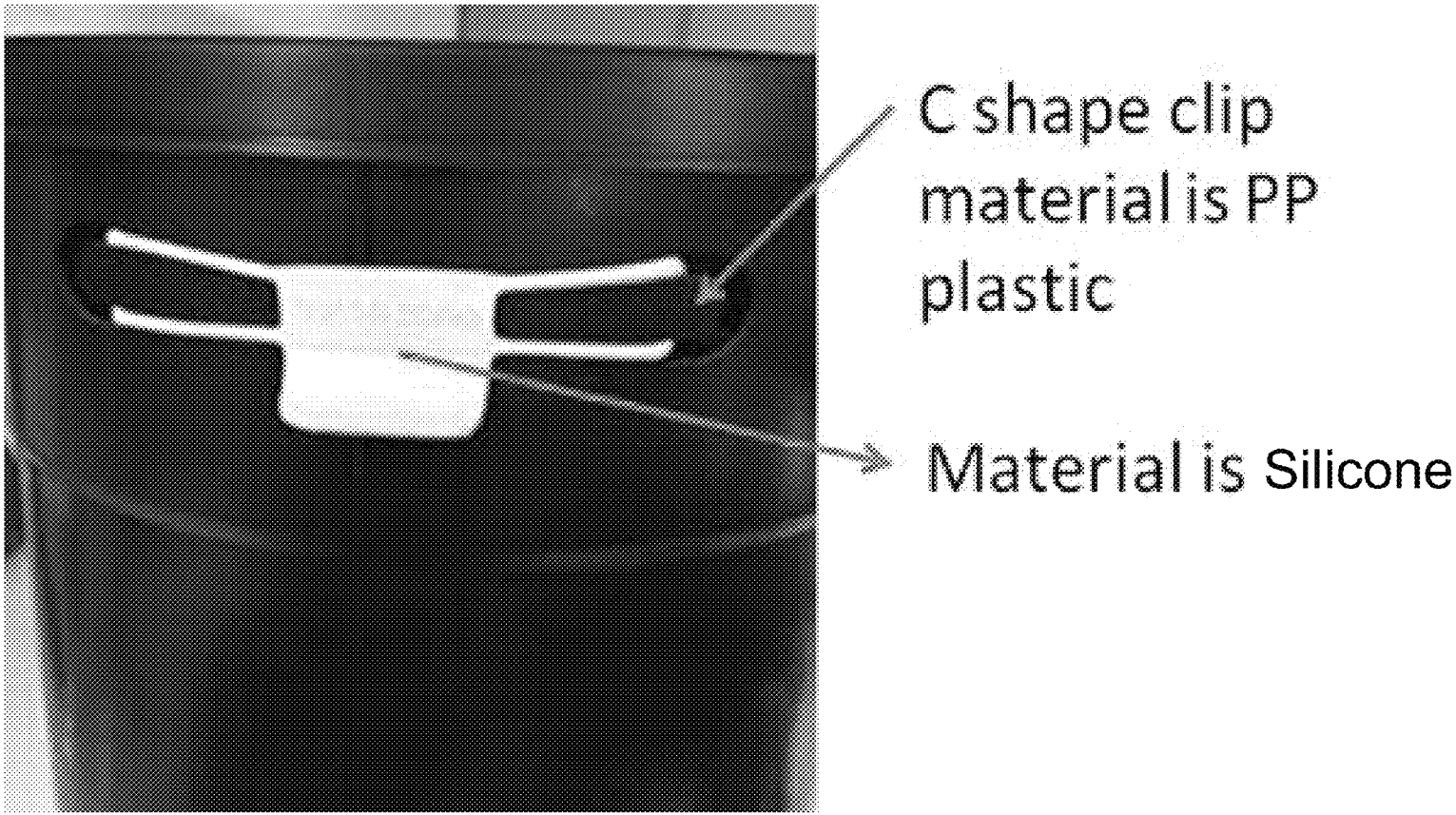
FIG. 25 is a picture of FIG. 1.

The liner engagement member in the present invention, has a length. Referring to FIG. 10, the distance between the left and right arm of the looping member is a length of the liner engagement member. In one example of present invention, the length of the holder is equal to or slightly less than the distance between the left and right clips of the holder, so that when the liner engagement member is placed on the clips having a gathered liner pass underneath the liner engagement member, the two lateral connecting elements and the stopping element are not loosely attached to the liner, but closely adhered to the liner, even the looping member or the liner stopping member is slightly stretched.

In accordance with the present invention, the present invention discloses a method of using the trash can assembly disclosed herein. The method includes providing a trashcan body having a base, a peripheral wall extending upwardly from said base, a top rim of said peripheral wall defining an opening of the trashcan body, and a pair of clips fixed on the exterior surface of the peripheral wall, folding a liner over the top rim of the trashcan body;

gathering the hanging over portion of the liner and passing it between the pair of the clips; and fastening a liner engagement member around the pair of the clips, so that the liner engagement member is adhered to the liner by friction.

Further, the liner engagement member is stretchable. Or the liner engagement member a resilient, semi-flexible plastic material.

By using the liner engagement member or the trash assembly described herein, a trash liner may then be secured to a respective peripheral wall. The liner engaging member can prevent the liner for the trashcan from falling into the trashcan body, even when trash is placed within the trashcan body with great force.

The invention claimed is:

1. A trash can assembly, comprising a trashcan body, comprising a base, a peripheral wall extending upwardly from said base, and a top rim of said peripheral wall defining an opening of the trashcan body;

a removable trashcan liner engagement member, capable of being substantially aligned with an exterior surface of the peripheral wall; and a holder for the trashcan liner engagement member, positioned on the exterior of the peripheral wall, configured to receive the trashcan liner engagement member, wherein when the trashcan liner engagement member is received by the holder, a trashcan liner can be folded over the top rim of the peripheral wall and gathered to pass underneath the trashcan liner engagement member, and wherein the removable trashcan liner engagement member comprises a looping element, capable of being placed around the holder, and a stopping element, connected to the looping element, and being adapted to prevent the trashcan liner from slipping.

2. The trashcan assembly of claim 1, wherein the holder is a pair of clips.

3. The trashcan assembly of claim 1, wherein the holder has a surface, which levels with the exterior surface of the peripheral wall of the trashcan.

4. The trashcan assembly of claim 2, wherein the clips are substantially C-shaped.

5. The trashcan assembly of claim 1, wherein the holder is an integral piece of the peripheral wall.

6. The trashcan assembly of claim 1, wherein the holder is made of polypropylene.

7. The trashcan assembly of claim 1, wherein the removable trashcan liner engagement member is stretchable.

8. The trashcan assembly of claim 7, wherein the removable trashcan liner engagement member is made of silicone.

9. The trashcan assembly of claim 1, wherein the looping element and the stopping element are one integral piece.

10. The trashcan assembly of claim 1, wherein the stopping element is curved.

11. The trashcan assembly of claim 1, wherein the removable trashcan liner engagement member has a different color from the trashcan.

12. The trashcan assembly of claim 2, wherein the distance between the two clips is equal to or greater than a length of the liner engagement member.

* * * * *